US008325034B2

(12) United States Patent
Moore

(10) Patent No.: US 8,325,034 B2
(45) Date of Patent: Dec. 4, 2012

(54) WEATHER ALERTS

(76) Inventor: Jason Lee Moore, Austin, TX (US)

( * ) Notice: Subject to any disclaimer, the term of this patent is extended or adjusted under 35 U.S.C. 154(b) by 0 days.

(21) Appl. No.: 13/279,270

(22) Filed: Oct. 22, 2011

(65) Prior Publication Data

US 2012/0044076 A1 Feb. 23, 2012

Related U.S. Application Data

(63) Continuation of application No. 12/422,953, filed on Apr. 13, 2009, now Pat. No. 8,089,356.

(51) Int. Cl.
*G08B 1/08* (2006.01)

(52) U.S. Cl. ..... 340/539.28; 340/540; 340/541; 340/600; 340/601; 340/602; 340/690; 72/2; 72/4

(58) Field of Classification Search ..... 340/539.28, 340/540, 541, 600, 601, 602, 690; 702/2, 702/4, 15

See application file for complete search history.

(56) References Cited

U.S. PATENT DOCUMENTS

| | | | | |
|---|---|---|---|---|
| 7,088,254 | B2 * | 8/2006 | Liebenow | 340/601 |
| 7,171,308 | B2 * | 1/2007 | Campbell | 702/4 |
| 7,486,201 | B2 * | 2/2009 | Kelly et al. | 340/905 |
| 2004/0183687 | A1 * | 9/2004 | Petite et al. | 340/601 |

* cited by examiner

*Primary Examiner* — Tai T Nguyen

(57) ABSTRACT

Systems and methods to generate weather alerts are provided. A particular system includes one or more sensors to detect weather data. The system also includes a weather band radio receiver to receive weather alert messages. The system also includes a processor to perform an analysis of the weather data, to determine based on the analysis whether the weather data indicates a dangerous storm condition, and to initiate a first alert when the analysis indicates the dangerous storm condition and a weather alert message has been received. The first alert is not initiated when the weather alert message is received and the analysis does not indicate the dangerous storm condition.

20 Claims, 5 Drawing Sheets

WEATHER ALERTS

CLAIM OF PRIORITY

This application is a continuation of and claims priority to U.S. patent application Ser. No. 12/422,953 now U.S. Pat. No. 8,089,356 filed Apr. 13, 2009, which is incorporated herein by reference in it entirety.

FIELD OF THE DISCLOSURE

The present disclosure is generally related to systems and methods to generate weather alerts.

BACKGROUND

Dangerous weather conditions cause enormous loss of life and property each year. According to some reports, tornados cause approximately 80 deaths and over 1500 injuries during an average year. Others are no doubt saved by receiving sufficient advance warning of dangerous weather conditions to take shelter. In the United States, the National Weather Service provides localized weather alert messages via a weather band radio system to give warning of dangerous weather conditions.

DETAILED DESCRIPTION

In a particular embodiment, a system to generate weather alerts includes an antenna to receive electromagnetic radiation. The system includes a weather band radio receiver to receive weather alerts. The system further includes a processor to perform an analysis of the received electromagnetic radiation and to determine based on the analysis whether the electromagnetic radiation indicates rotation in a storm system. The processor initiates an alert when the analysis indicates rotation in the storm system and a weather alert has been received.

A particular method to generate weather alerts includes receiving electromagnetic radiation. The method also includes monitoring a weather radio band. The method further includes analyzing the received electromagnetic radiation to determine based on the analysis whether the electromagnetic radiation indicates rotation in a storm system. The method further includes initiating a first alert when the analysis indicates rotation in the storm system and a weather alert has been received.

In another particular embodiment, a method to generate weather alerts includes receiving weather related data from at least one remote device via a mobile communication network (such as a cellular telephone network). The weather related data is determined by comparing electromagnetic radiation received at the at least one remote device to at least one predetermined storm model. The method further includes transmitting information to at least one second remote device. The information indicates that the weather related data received from the at least one first remote device indicates a potential danger.

Figure 1:
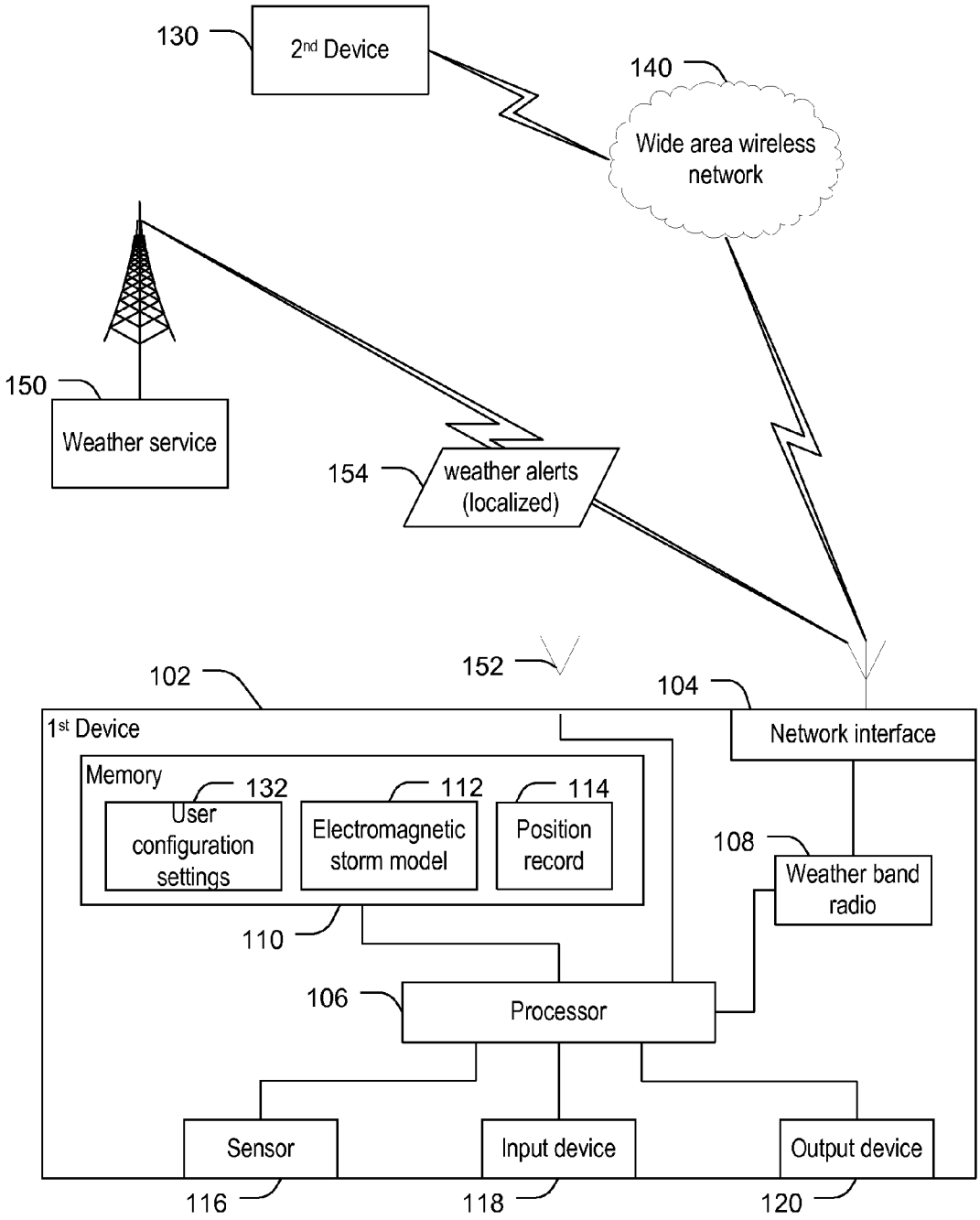
FIG. 1 is a block diagram of a first particular embodiment of a system to generate weather alerts.

FIG. 1 is a block diagram of a first particular embodiment of a system to generate weather alerts. The system includes a first device 102 to generate weather alerts. For example, the first device 102 may include an output device 120 to indicate a weather alert. The output device 120 may include, but is not limited to, a speaker or other sound generating device (e.g., a buzzer), a light emitting diode or other light generating device, a vibrating element or other haptic output device, a display device, another output device, or any combination thereof.

In a particular embodiment, the output device 120 is responsive to a weather band radio 108 to generate an alert when a weather alert message 154 is received from a weather service 150. The weather alert message 154 may be general or localized. For example, the weather service 150 may send weather alert messages for different regions (such as counties) via different channels, using different encoding methodologies, or in another manner that indicates the location to which the weather alert message 154 pertains. The first device 102 may be programmable to receive particular localized weather alerts based on a location of the first device. For example, the first device 102 may include a switch or other input device 118 (such as a keyboard, touch screen, keypad, mouse, etc.) to select a region associated with the first device 102. In another example, the first device 102 may include a memory 110 that stores a position record 114 associate with the first device 102. The position record 114 may include a geographic location of the first device 102 or region code associated with certain localized weather alerts. The position record 114 may be input by a user, preprogrammed into the memory 110, or determined automatically (e.g., based on a global positioning receiver or other position determination system).

The first device 102 may also include an antenna 152 to receive electromagnetic radiation. The antenna 152 may be coupled to a processor 106. The processor 106 may perform an analysis of the electromagnetic radiation received by the antenna 152. The processor 106 may determine based on the analysis whether the electromagnetic radiation indicates rotation in a storm system near the first device 102. In this context, "near" may be a variable or not specifically defined distance that is close enough to the first device 102 for the electromagnetic radiation to be detected by the first device 102 or to have a particular strength at the first device 102. The rotation may indicate that the storm system includes or has the potential to generate a tornado. For example, the antenna 152 may receive ambient electromagnetic radiation generated by the storm system. In particular, rotating particles in the storm system may generate a detectable electromagnetic signal. The processor 106 may analyze the electromagnetic radiation by comparing the detected electromagnetic radiation to a predetermined electromagnetic storm model 112 stored in the memory 110.

In a particular embodiment, the processor 106 may initiate an alert via the output device 120 when the processor 106 determines that the analysis indicates rotation in the storm system. For example, the processor 106 may generate an alert when the received electromagnetic radiation matches one or more of the predetermined electromagnetic storm models 112. In another example, the processor 106 may generate an alert when the received electromagnetic radiation indicates rotation in the storm system and a weather alert message 154 has been received. For example, when the weather service 150 has issued a severe weather watch or a severe weather warning and the received electromagnetic radiation indicates rotation in the storm system, the alert may be generated.

In a particular embodiment, the first device 102 includes at least one sensor 116 coupled to the processor 106. For example, the sensor 116 may include a barometer, a microphone or another sensor capable of detecting indications of dangerous storm conditions. In this embodiment, the analysis performed by the processor 106 may determine whether to initiate the alert based on information received from the at least one sensor 116. For example, the processor 106 may generate an alert when the received electromagnetic radiation indicates rotation in the storm system and when the sensor 116 detects another indication of a dangerous storm conditions.

The first device 102 may also include a network interface 104. The network interface 104 may receive information via a wide area wireless network 140 from one or more other devices, such as a second device 130. In a particular embodiment, the processor 106 determines whether to initiate an alert based at least partially on information received from the second device 130. For example, the second device 130 may be within a predetermined geographic location relative to the first device 102 (e.g., within a predetermined distance, within a same localized alert area, etc.). The processor 106 may generate an alert when the second device 130 detects rotation in a storm system near the second device 130. Thus, the network interface 104 may receive information indicating whether another device (such as the second device 130) within a predetermined distance of the first device 102 has determined that rotation is present in the storm system. The first device 102 may also send information to the second device 130 or to another device via the network interface 104 when the processor 106 identifies rotation in the storm system.

In a particular embodiment, the alert may be selected based on user input. For example, a user may utilize the input device 118 to indicate when an alert should be initiated, a type of alert to be initiated, or both. For example, a first alert may be initiated when the weather alert message 154 is received and received electromagnetic radiation does not indicate rotation in the storm system, a second alert may be initiated when the weather alert message 154 has been received and the received electromagnetic radiation indicates rotation in the storm system, a third alert may be initiated when no weather alert message 154 has been received and the received electromagnetic radiation indicates rotation in the storm system. In embodiments that include the sensor 116, other combinations of alerts may also be used. For example, a fourth alert may be initiated when the weather alert message 154 is received but the received electromagnetic radiation does not indicate rotation in the storm system and the sensor 116 does not indicate a dangerous storm condition. A fifth alert may be initiated when the weather alert message 154 has been received and the received electromagnetic radiation indicates rotation in the storm system but the sensor 116 does not indicate a dangerous storm condition. A sixth alert may be initiated when the weather alert message 154 has been received, the received electromagnetic radiation indicates rotation in the storm system and the sensor 116 indicates a dangerous storm condition. A seventh alert may be initiated when no weather alert message 154 has been received and the sensor 116 does not indicate a dangerous storm condition but the received electromagnetic radiation indicates rotation in the storm system. An eighth alert may be initiated when no weather alert message 154 has been received and the received electromagnetic radiation does not indicate rotation in the storm system but the sensor 116 indicates a dangerous storm condition. Other combinations and alerts are also possible as illustrated in Table 1. Table 1 also illustrates that the alert may be generated based at least partially on information received from the second device 130, as is described further with reference to FIG. 2.

TABLE 1

Alert selected based on information available at first device 102.

| Alert | Weather alert message | Rotation detected | Sensor | Alerts from Other devices |
|---|---|---|---|---|
| 1 | yes | no | no | no |
| 2 | no | yes | no | no |
| 3 | no | no | yes | no |
| 4 | no | no | no | yes |
| 5 | yes | yes | no | no |
| 6 | yes | no | yes | no |
| 7 | yes | no | no | yes |
| 8 | no | yes | no | no |
| 9 | no | yes | yes | no |
| 10 | no | yes | no | yes |
| 11 | no | no | yes | yes |
| 12 | yes | yes | yes | no |
| 13 | yes | no | yes | yes |
| 14 | yes | yes | no | yes |
| 15 | no | yes | yes | yes |
| 16 | yes | yes | yes | yes |

In a particular embodiment, the input device 118 is operable by the user to indicate whether the alert should be initiated based on the particular situation as indicated in Table 1 and a particular type of alert that should be initiated. To illustrate, when a weather alert message 154 is received, a light emitting diode of the output device 120 may be powered as alert number 1 of Table 1. When the received electromagnetic radiation indicates rotation, an audible alert may be initiated at the output device 120 as alert number 2 of Table 1. As discussed above, other combinations are also possible. Each alert of Table 1 may be preselected (e.g., by a manufacturer of the first device 102) or may be based on the user configuration settings 132. Further, while only one column is shown for alerts being received from other devices, the particular alert selected may depend on receiving alerts from a predetermined number of other devices (e.g., two or more).

In a particular embodiment, the type of alert, the circumstance that cause the alert to be initiated, or both, may also be based at least partially on the time of day. For example, during daytime hours, an audible alert may be generated when the weather alert message 154 is received; however, during nighttime hours, the audible alert may be initiated when the weather alert message 154 has been received and when the electromagnetic radiation indicates rotation in the storm system. Thus, the user may be awakened only when a dangerous condition is detected but not when an alert message is received from the weather service 150.

In a particular embodiment, when an alert is initiated, the alert indicates why the alert was initiated. For example, the alert may include a voice message selected from a predetermined set of voice alert messages stored in the memory 110. Each voice alert message may indicate the reason that the alert was initiated. For example, a first voice alert message may indicate that a weather alert message 154 was received (and may further indicate a type of the weather alert message 154). A second voice alert message may indicate that rotation has been detected in the storm system. A third voice alert message may indicate that a dangerous storm condition has been detected by the sensor 116. Other alert messages or combinations of messages may also be used.

Figure 2:
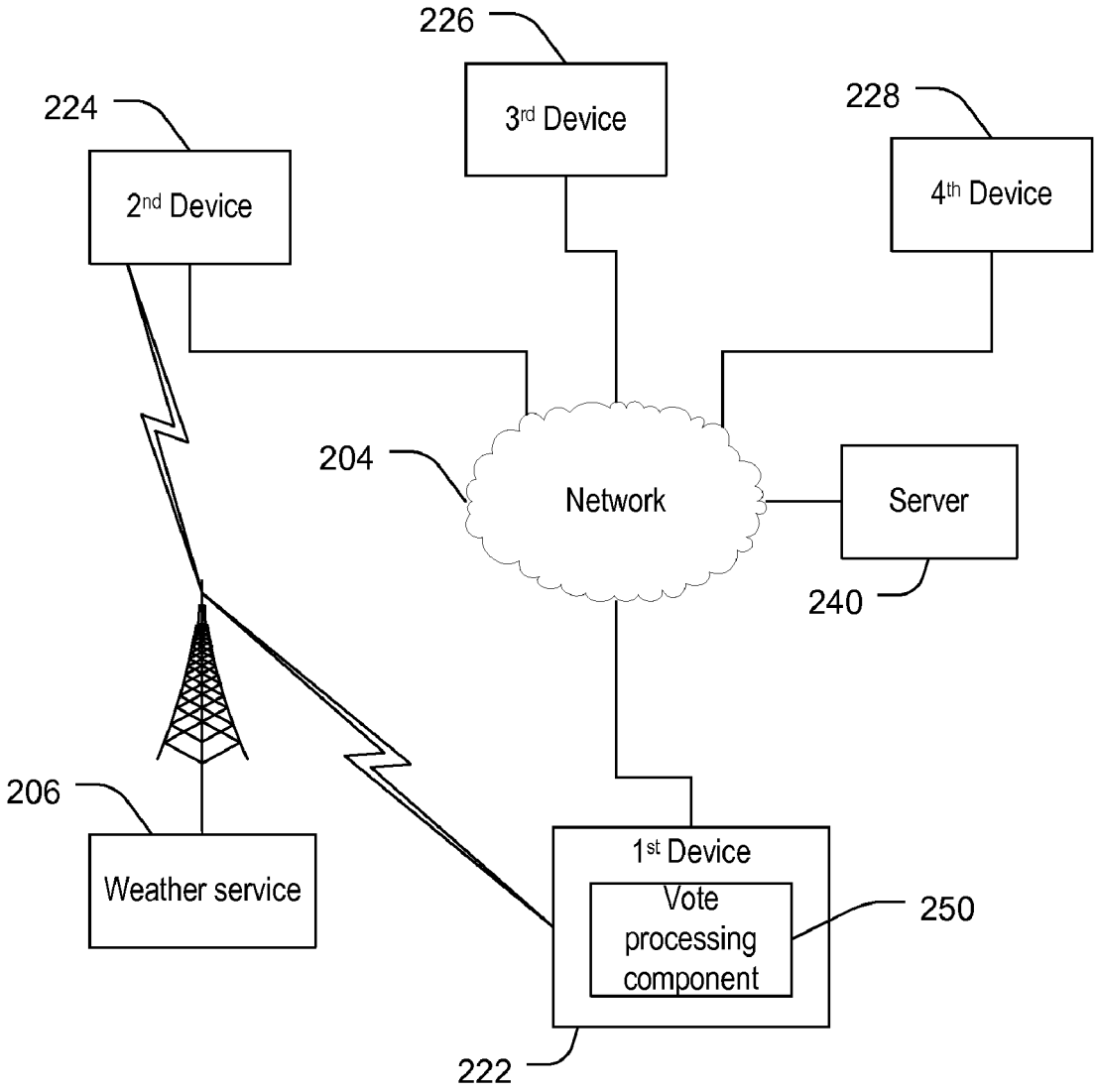
FIG. 2 is a block diagram of a second particular embodiment of a system to generate weather alerts.

FIG. 2 is a block diagram of a second particular embodiment of a system to generate weather alerts. The system includes first device 222 in communication with one or more other devices, such as a second device 224, a third device 226 and a fourth device 228 via a network 204. One or more of the devices 222-228 may include a weather band radio, a processor and a memory, such as the first device 102 of FIG. 1.

In a particular embodiment, one or more of the devices 222-228 may include a position record that includes location information regarding the device 222-228. In this embodiment, each of the devices 222-228 may communicate the position record or other location information to the other devices 222-228 to a remote network device, such as a server 240. The devices 222-228 may use the location information to identify nearby devices. In an illustrative embodiment, a nearby device includes a device that is within a same geographic region, such as within a localized weather alert region, e.g., a county, a city, a state, or a portion thereof or within a predetermined distance. To illustrate, the first device 222 may determine that the second device 224, the third device 226 and the fourth device 228 are nearby to the first device 222.

In a particular embodiment, the devices 222-228 may communicate alert information with one another via the network 204. For example, when the second device 224 identifies rotation in storm system near the second device 224, the second device 224 may send alert information to one or more of the other devices 222, 226, 228 via the network 204. In another example, one or more of the devices 222-228 may include sensors to identify other dangerous storm conditions, a weather band radio, or other devices to identify dangerous weather conditions. When the device 222-228 identifies a dangerous weather condition the device 222-228 may send alert information to the one or more other devices 222-228. Alternately, the device 222-228 may send alert information only when the dangerous weather condition is identified by particular devices. For example, when rotation is identified based on electromagnetic radiation or another sensor local to the device 222-228, the device 222-228 may send the alert information. In this example, when the dangerous weather condition is identified based on a weather alert message, the device 222-228 may not send the alert information.

In a particular embodiment, rather than sending the alert information to the other devices 222-228, a device 222-228 that identifies a dangerous weather condition may send the alert information to the server 240. The server 240 may select one or more other devices 222-228 to send alert information to. For example, the server 240 may select one or more devices near the device that sent the alert information and send the alert information to the selected one or more devices.

One or more of the devices 222-228, the server 240, or any combination thereof may include a vote processing component 250. The vote processing component 250 may determine whether to generate an alert based on alert information received from the other devices 222-228. To illustrate, during operation, alert information may be received at the first device 222 from the second device 224. The vote processing component 250 may determine whether to generate an alert at the first device 222 based on alert information and other information available at the first device 222, such as weather alert messages received at the first device 222, information from other sensors at the first device 222, other alert information received from other devices 226-228, or any combination thereof. When alert information is received from more than one device, such as the second device 224 and the third device 226, the vote processing component 250 may determine whether to generate an alert based on how many devices alert information is received from, the content of the alert information, distance from the first device 222 to each of the other devices 224, 226 that sent alert information, or any combination thereof. For example, alert information received from closer devices may be weighted more heavily than alert information received from more distant devices. To illustrate, when the second device 224 and the third device 226 are relatively near the first device 222 and the fourth device 228 is relatively far from the first device, and alert information is received from the fourth device 228 but no alert information is received from the second device 224 or the third device 226, the vote processing component 250 may determine not to generate an alert. However, when alert information is received from the second device 224 but not the third 226 or the fourth device 228, the first device 222 may determine to generate an alert. Other combinations are also possible depending on the number of nearby devices, alert information sent from each device, and specific user configuration of each device. Thus, when the second device 224 sends alert information to the first device 222 and the third device 226, the first device 222 may generate an alert based on user configuration settings at the first device 222; whereas, the third device 226 may not generate an alert based on the user configuration settings at the third device 226. Further, based on the user configuration settings at a particular device 222-228, the particular device 222-228 may generate an alert based solely on alert information received from another device. That is, even though conditions detected at the first device 222 do not indicate a dangerous weather condition, the first device 222 may nonetheless generate an alert based on alert information received from one or more of the other devices 224-228.

In a particular embodiment, alert information sent from one or more of the devices 222-228 may be logged by the server 240. When alert information meeting particular conditions is received at the server 240, the server 240 may send a notice to a weather service 206, such as a governmental agency. The server 240 may additionally or in the alternative, send a command to one or more of the devices 222-228 to generate an alert regardless of the user configuration settings at the devices 222-228 when the alert information meets the particular conditions. For example, when two or more devices 222-228 that are within a particular distance of one another both identify rotation in a storm system, the server 240 may determine that a dangerous weather condition exists. The server 240 may command the devices 222-228 to generate an alert and/or notify the weather service 206. When the server 240 sends information to the weather service 206, the weather service 206 may send a weather alert message via a weather band. Thus, other, relatively simple, weather band radio devices (i.e., devices that are not equipped to independently identify dangerous weather conditions) may generate alerts based on the weather alert message. Further, the devices 222-228 may act as distributed remote sensors to assist the weather service in identifying or confirming dangerous weather conditions.

Figure 3:
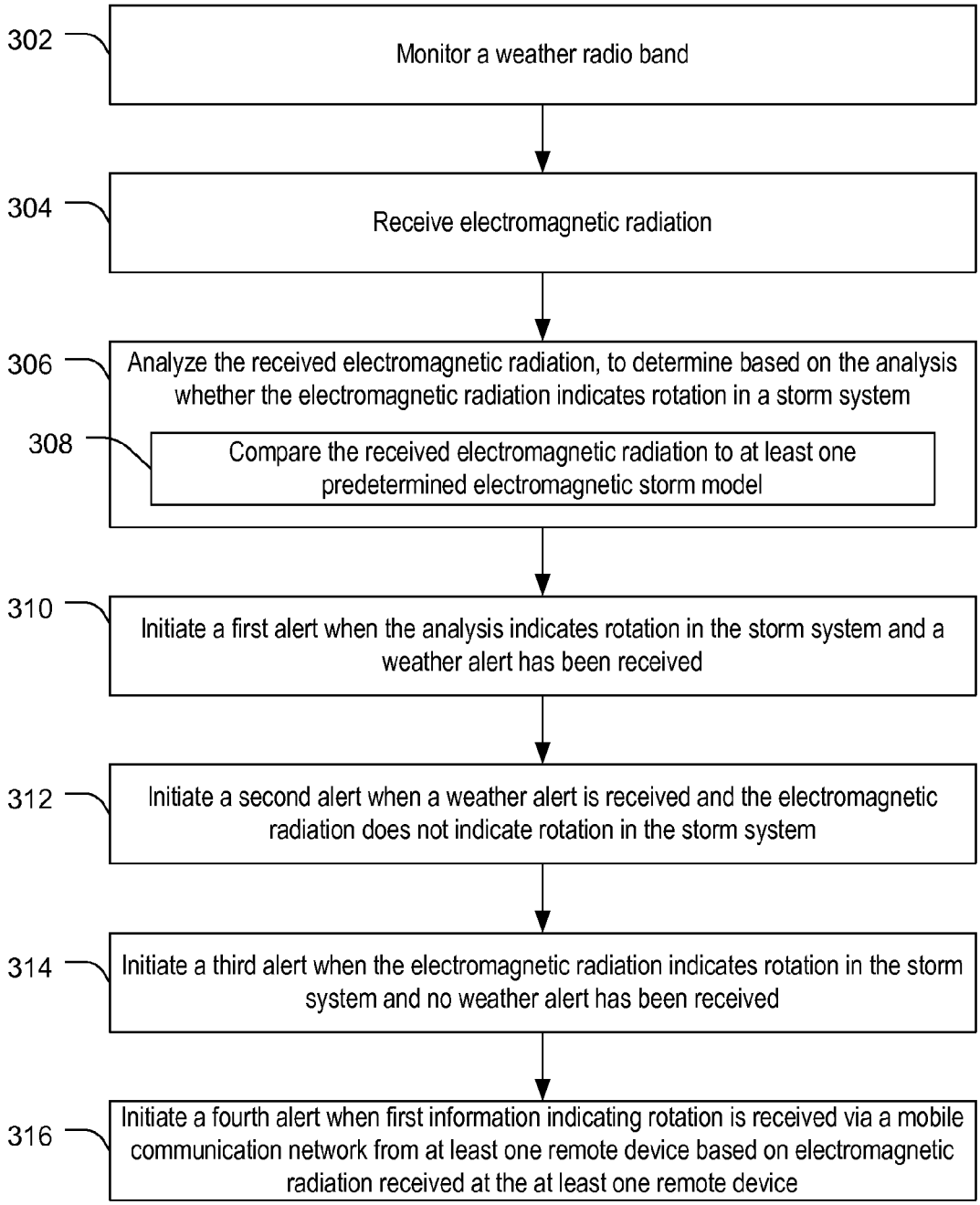
FIG. 3 is a flow diagram of a first particular embodiment of a method to generate weather alerts.

FIG. 3 is a flow diagram of a first particular embodiment of a method to generate weather alerts. The method includes, at 302, monitoring a weather band radio. For example, the weather band radio may be monitored for receipt of a weather alert message from a weather service.

The method also includes, at 304, receiving electromagnetic radiation. For example, ambient electromagnetic radiation generated by a nearby storm system may be received. The method also includes, at 306, analyzing the received electromagnetic radiation to determine based on the analysis whether the electromagnetic radiation indicates rotation in the storm system. For example, analyzing the received electromagnetic radiation may include, at 308, comparing the received electromagnetic radiation to at least one predetermined electromagnetic storm model.

To illustrate, storms in which rotation is present may emit ultra-low frequency (ULF) radiation that is detectable by antennas near the storm. Electromagnetic radiation that is detected may be analyzed using a Fast Fourier Transform (FFT) method to determine whether detectable oscillations are present. For example, in tests conducted by Leeman, et al. (Electrical Signals Generated by Tornados, Atmospheric Research, 2008) oscillations with a period of about one second were reported when rotation was present in a storm system that produced a tornado. The oscillations were reportedly detected using FFT analysis that indicated a defined spike at around 1.2 Hz that slightly increased with shrinking funnel diameter.

The method may also include, at 310, initiating a first alert when the analysis indicates rotation in the storm system and a weather alert has been received. The method may also include, at 312, initiating a second alert when a weather alert is received and the electromagnetic radiation does not indicate rotation in the storm system. The second alert may be distinct from the first alert. The method may further include, at 314, initiating a third alert when the electromagnetic radiation indicates rotation in the storm system and no weather alert has been received. The third alert may be distinct from the first alert and the second alert. In a particular embodiment, at least one of the first alert, the second alert and the third alert include a voice message indicating why the alert was initiated. For example, the voice message may indicate that rotation was detected in a nearby storm system, that a weather alert message was received, that another sensor or another device has detected a dangerous weather condition, or any combination thereof. The method may also include, at 316, initiating a fourth alert when first information indicating rotation is received via a mobile communication network from at least one remote device based on electromagnetic radiation received at the at least one remote device. Other combinations are also envisioned, such as was described with reference to Table 1.

Figure 4:
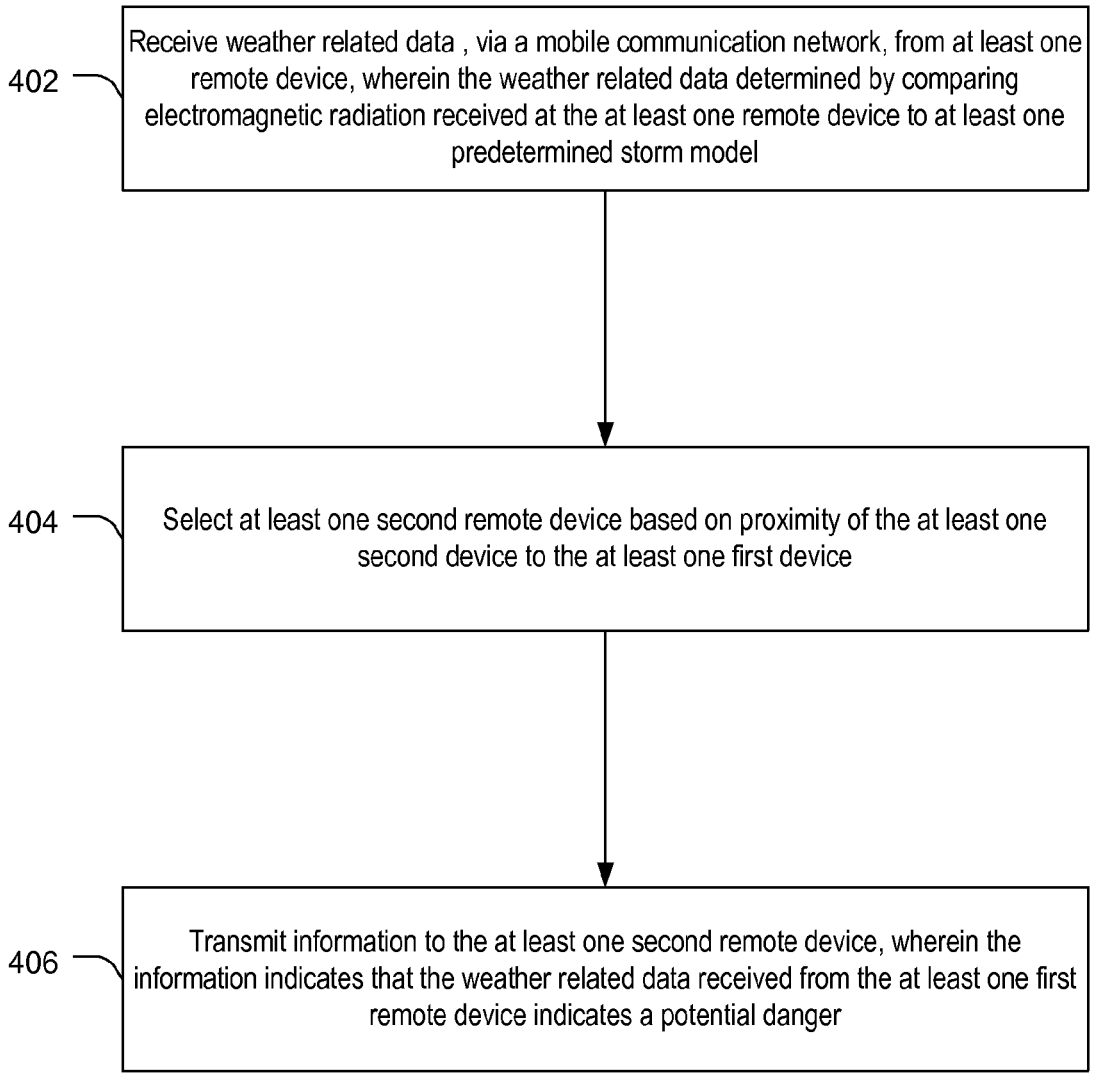
FIG. 4 is a flow diagram of a second particular embodiment of a method to generate weather alerts.

FIG. 4 is a flow diagram of a second particular embodiment of a method to generate weather alerts. The method may include, at 402, receiving weather related data via a mobile communication network from at least one remote device. In a particular embodiment, the weather related data is determined by comparing electromagnetic radiation received at the at least one remote device to at least one predetermined storm model. The method also includes, at 404, transmitting information to at least one second remote device. The information may indicate that the weather related data received from the at least one first remote device indicates a potential danger. The method may also include, at 406, selecting the at least one second remote device based on proximity of the at least one second device to the at least one first device.

Figure 5:
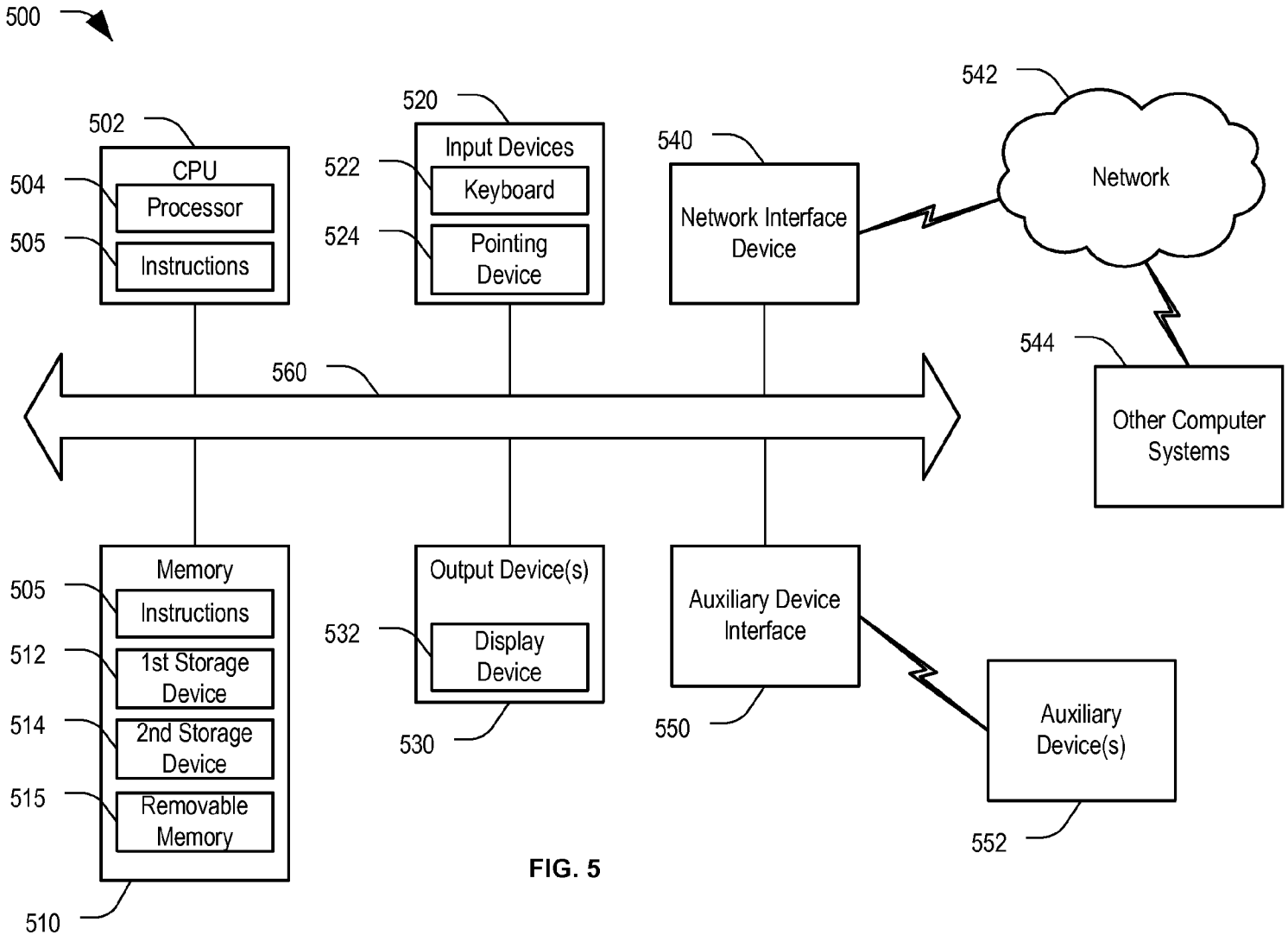
FIG. 5 is a block diagram of a particular embodiment of a general computer system.

FIG. 5 is a block diagram of a particular computer system 500 suitable for carrying out processing in accordance with one embodiment of a method to generate weather alerts. For example, the computer system 500 may include, or be included within, one or more of the devices, wide area wireless networks, or servers described with reference to FIGS. 1 and 2. The computer system 500 can also be implemented as or incorporated into a weather alert radio consumer product or various other devices, such as a personal computer (PC), a tablet PC, a set-top box (STB), a personal digital assistant (PDA), a mobile device, a palmtop computer, a laptop computer, a desktop computer, a communications device, a wireless telephone, or any other machine capable of executing a set of instructions (sequential or otherwise) that specify actions to be taken by that machine. Further, while a single computer system 500 is illustrated, the term "system" includes any collection of systems or sub-systems that individually or jointly execute a set, or multiple sets, of instructions to perform one or more computer functions.

While FIG. 5 illustrates one embodiment of the particular computer system 500, other computer systems or computing architectures and configurations may be used for carrying out the methods of generating weather alerts disclosed herein. The computer system 500 includes at least one microprocessor subsystem (also referred to as a central processing unit, or CPU) 502. The CPU 502 can be implemented using a single-chip processor 504 or using multiple processors. In a particular embodiment, the CPU 502 is a programmable digital processor which controls the operation of the computer system 500. For example, using instructions 505 retrieved from a memory 510, the CPU 502 may control the reception and manipulation of input data, and the generation of output data (e.g., to a display or other output device). The CPU 502 may interact with other components or subsystems of the computer system 500 via a bus 560. The bus 560 is illustrative of any interconnection scheme serving to link the subsystems of the computer system 500, external subsystems or device, or any combination thereof.

The CPU 502 may be coupled to the memory 510. The memory 510 may include any suitable computer-readable storage media depending on, for example, whether data access needs to be bi-directional or unidirectional, speed of data access desired, memory capacity desired, other factors related to data access, or any combination thereof. The memory 510 may include various memory devices, such as registers, caches, volatile memory, and non-volatile memory. For example, the memory 510 can include cache accessible by the CPU 502 to rapidly retrieve and store frequently needed data. The memory 510 can also include one or more storage areas, such as a first storage device 512 and a second storage device 514. In a particular embodiment, the first storage device 512 may include random access memory (RAM), and the second storage device 514 may include a read-only memory (ROM). The storage device(s) 512, 514 may include operating instructions 505 (e.g., program code) and, data used by the CPU 502 to perform its functions.

In a particular embodiment, the memory 510 may also include a removable memory device 515 to provide additional data storage capacity. The removable memory device 515 may be coupled either bi-directionally or unidirectionally to CPU 502 via the bus 560. For example, a specific removable memory device 515 commonly known as a CD-ROM may pass data unidirectionally to the CPU 502, whereas other specific removable memory device 515 may pass data bi-directionally to the CPU 502 (e.g., a Universal Serial Bus (USB) flash memory). In various embodiments, the removable memory device 515 may include computer-readable storage media such as magnetic tape, flash memory, PC-CARDS, portable mass storage devices, optical or holographic storage devices, magnetic or electromagnetic storage devices, and other storage devices. Like the storage device(s) 512, 514, the removable memory device 515 may include operating instructions 505 (e.g., program code) and, data used by the CPU 502 to perform its functions.

In addition to providing CPU 502 access to storage subsystems, the bus 560 can be used to provide access to other subsystems and devices as well. These can include, for example, output devices 530, input devices 520, a network interface device 540 and an auxiliary device interface 550. The output devices 530 may include a display device 532, speakers, a printer, a television, a projector, or another device to provide an output of data in a manner that is perceptible by a user. The network interface device 540 may include a wireless network interface (e.g., a Wifi, WiMax, PCS, 3G, Bluetooth, 802.11x interface), a modem, a Ethernet interface, or another device to output data to or to receive data from another computer system 544 or other machine via a network 542. The input devices 520 may be relatively simple, such as one or more buttons, switches or knobs, or more complex, such as a keyboard 522, a pointing device 524, a biometric device, a microphone, a motion sensor, or another device to sense or receive user input. In various embodiments, the pointing device 524 includes a mouse, a stylus, a track ball, a pen, a touch pad, a touch screen, a tablet, another device that is useful for interacting with a graphical user interface, or any combination thereof. The auxiliary device interface 550 may couple to auxiliary devices 552 such as, a sound card, a video card, a graphics processing unit (GPU), or any combination thereof.

The network interface device 540 allows the CPU 502 to be coupled to one or more other computer systems 544, computer networks 542, or other networks using a computer communications protocol. For example, the computer system 500 may receive information (e.g., data objects or program instructions) from the other computer system 544, or may output information to the other computer system 544 through the network interface device 540. Information, such as a set of instructions 505 to be executed at a CPU (e.g., the CPU 502), may be received from or outputted to the other computer system 544 in the form of a computer data signal embodied in a carrier wave. The network interface device 540 can be used to transfer data according to standard protocols (such as, TCP/IP, UDP/IP, HTML, HTTP, DHCP, FTP, SMTP, POP3, and IMAP). Thus, for example, in various embodiments, methods of generating weather alerts may be executed by the computer system 500 alone, or may be performed in a distributed manner by the computer system 500 working in conjunction with one or more other computer systems 544 via the network 542. In a particular embodiment, the network 542 is a wide area network (WAN), such as the Internet, an intranet network, a WiFi network, or a telecommunication network (such as a mobile telephone network). In other embodiments, the network 542 includes a local area network (LAN), such as an intranet network, or an 802.11x wireless network. Additionally, at least a portion of the memory 510 may be connected to CPU 502 through the network interface device 540.

The computer system 500 may be coupled to one or more auxiliary devices 552 via the auxiliary device interface 550. The auxiliary device interface 550 can include standard interfaces or custom interfaces that allow the CPU 502 to send and/or receive data from auxiliary devices 552 (such as, personal digital assistants, cameras, and the like). Examples of standard auxiliary device interfaces include USB ports, IEEE 1284 ports, IEEE 1394 ports, serial ports, parallel ports, PS/2 ports, DVI ports, SCSI ports, among others.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present disclosure encompasses software, firmware, and hardware implementations.

In addition, embodiments disclosed herein may include computer storage products with a computer-readable storage medium that includes instructions (e.g., program code and data) for performing various computer-implemented operations. The computer-readable storage medium can include any data storage device that can store data which can thereafter be read by a computer system, such as the computer system 500. Examples of computer-readable storage media include, but are not limited to: magnetic media, such as hard disks, floppy disks, and magnetic tape; optical media, such as CD-ROM disks; magneto-optical media, such as floptical disks; and specially configured hardware devices, such as application-specific integrated circuits (ASICs), programmable logic devices (PLDs), and ROM and RAM devices.

Although components and functions described herein have referred to particular standards and protocols, the embodiments disclosed are not limited to such standards and protocols. For example, standards for Internet and other packet switched network transmission (e.g., TCP/IP, UDP/IP, HTML, HTTP, and so forth) represent examples of the state of the art. Such standards are periodically superseded by faster or more efficient equivalents having essentially the same functions. Accordingly, replacement standards and protocols having the same or similar functions as those disclosed herein are considered equivalents thereof.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be reduced. Accordingly, the disclosure and the figures are to be regarded as illustrative rather than restrictive.

Although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim or that the features and functions disclosed in one embodiment may not also be present in another embodiment. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all such modifications, enhancements, and other embodiments, which fall within the scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A device, comprising:

one or more sensors to detect weather data;

a network interface to receive information from a remote device, wherein the information relates to a storm condition at a location of the remote device, wherein the remote device is not a component of a weather service;

a weather band radio receiver to receive weather alert messages from the weather service; and a processor to perform an analysis, to determine based on the analysis whether the weather data, the received information, or both indicate a dangerous storm condition, and to initiate a first alert in a first condition, wherein the first alert is not initiated in a second condition, wherein the first condition corresponds to the weather alert message having been received and the analysis indicating the dangerous storm condition, and wherein the second condition corresponds the weather alert message having been received and the analysis not indicating the dangerous storm condition.

2. The device of claim 1, wherein the analysis includes comparing the weather data to at least one predetermined storm model.

3. The device of claim 1, wherein the weather data comprises electromagnetic radiation, and wherein the dangerous storm condition is indicated when the electromagnetic radiation indicates potential tornadic rotation in a storm system.

4. The device of claim 1, wherein a second alert distinct from the first alert is initiated in a third condition, the third condition corresponding to the weather data indicating the dangerous storm condition and the weather alert message having not been received.

5. The device of claim 1, further comprising an input device operable by a user to receive data specifying user configuration settings related to when alerts are initiated.

6. The device of claim 1, wherein the location of the remote device is within a predetermined distance from the device.

7. The device of claim 1, wherein the network interface receives the information via a wide area wireless network.

8. The device of claim 1, wherein the network interface is adapted to send information indicating that the dangerous storm condition has been identified after the dangerous storm condition is identified and when no weather alert has been received.

9. The device of claim 1, further comprising a vote processing component to determine whether to generate a particular alert based on alert information received from two or more other devices, wherein first alert information received from a closer device is weighted more heavily than second alert information received from a more distant device.

10. A method, comprising:

sensing weather data;

monitoring a weather radio band;

receiving information from a remote device, wherein the information relates to a storm condition at a location of the remote device, wherein the remote device is not a component of a weather service;

performing an analysis of the weather data and the received information to determine based on the analysis whether the weather data, the received information, or both indicate a dangerous storm condition; and determining whether to initiate an alert based on the analysis, wherein a first alert is generated in a first condition and the first alert is not generated in a second condition, wherein the first condition corresponds to the analysis indicating the dangerous storm condition and a weather alert message having been received, wherein the second condition corresponds to the weather alert message having been received and the analysis not indicating the dangerous storm condition.

11. The method of claim 10, wherein the weather data comprises electromagnetic radiation sensed from an ambient environment, the method further comprising initiating a second alert that is distinct from the first alert in a third condition, wherein the third condition corresponds to the weather alert message having been received and the electromagnetic radiation does not indicating tornadic rotation in a storm system.

12. The method of claim 10, wherein performing the analysis comprises comparing the weather data to at least one predetermined storm model.

13. The method of claim 10, further comprising initiating a third alert that is distinct from the first alert in the second condition.

14. The method of claim 10, wherein one or more alerts include a voice message indicating why the one or more alerts were triggered.

15. The method of claim 10, further comprising:

receiving second information from a second device; and determining whether to generate a particular alert based on the received information and the received second information, wherein information received from a closer device of the remote device and the second device is weighted more heavily than information received from a more distant device of the remote device and the second device.

16. The method of claim 10, wherein the first alert is indicated by first output at a first time of day and is indicated by second output at a second time of day.

17. A device comprising:

one or more sensors to detect weather data;

a weather band radio receiver to receive weather alert messages;

a vote processing component to determine whether to generate a particular alert based on alert information received from two or more other devices, wherein first alert information received from a closer device is weighted more heavily than second alert information received from a more distant device; and a processor to perform an analysis of the weather data, to determine based on the analysis whether the weather data indicates a dangerous storm condition, and to initiate a first alert in a first condition, wherein the first alert is not initiated in a second condition, wherein the first condition corresponds to the analysis indicating the dangerous storm condition and a weather alert message having been received, and the second condition corresponds to the weather alert message having been received and the analysis not indicating the dangerous storm condition.

18. The device of claim 17, wherein the dangerous storm condition is detected based on ultra-low frequency electromagnetic radiation.

19. A method comprising:

sensing weather data;

monitoring a weather radio band;

receiving alert information from two or more remote devices;

performing an analysis of the weather data and the alert information received from the two or more remote devices, wherein first alert information received from a closer device is weighted more heavily for the analysis than second alert information received from a more distant device;

determining based on the analysis whether a dangerous storm condition is indicated; and determining a particular alert to be generated when the dangerous storm condition is indicated.

20. The method of claim 19, wherein a first alert is generated in a first condition, the first condition corresponding to the analysis indicating the dangerous storm condition and a weather alert message having been received, and wherein a second alert distinct from the first alert is generated in a second condition, the second condition corresponding to the weather alert message having bee received and the analysis not indicating the dangerous storm condition.

* * * * *